US006848681B2

(12) United States Patent
Washington et al.

(10) Patent No.: US 6,848,681 B2
(45) Date of Patent: Feb. 1, 2005

(54) WATER-DRIVEN BLOWER VENTILATION EXHAUST SYSTEM

(76) Inventors: LaDon K. Washington, 2282 Luana Dr. East, Jacksonville, FL (US) 32246; Charles A. Burgess, 814B Edson Cir. West, Jacksonville, FL (US) 32227

( * ) Notice: Subject to any disclaimer, the term of this patent is extended or adjusted under 35 U.S.C. 154(b) by 61 days.

(21) Appl. No.: 10/400,876

(22) Filed: Mar. 27, 2003

(65) Prior Publication Data

US 2004/0188868 A1 Sep. 30, 2004

(51) Int. Cl.[7] ..... B01F 3/04

(52) U.S. Cl. ..... 261/76; 261/116; 261/DIG. 75; 415/202

(58) Field of Search ..... 261/76, 116, DIG. 75; 415/202, 208.1

(56) References Cited

U.S. PATENT DOCUMENTS 2,436,038 A * 2/1948 Farrell ..... 454/342
4,162,971 A * 7/1979 Zlokarnik et al. ..... 210/620
4,170,458 A * 10/1979 Hartwick ..... 95/189
4,272,499 A * 6/1981 Cason et al. ..... 423/243.08
4,487,553 A * 12/1984 Nagata ..... 417/171
4,633,909 A * 1/1987 Louboutin et al. ..... 137/888
4,970,030 A * 11/1990 Prudhon et al. ..... 261/79.2
4,986,364 A * 1/1991 Clark ..... 169/48
5,037,585 A * 8/1991 Alix et al. ..... 261/142
5,125,797 A * 6/1992 Kapich ..... 415/202
5,167,878 A * 12/1992 Arbisi et al. ..... 261/30
5,587,113 A * 12/1996 Caballero Pichardo ..... 261/116

* cited by examiner

*Primary Examiner*—Richard L. Chiesa
(74) *Attorney, Agent, or Firm*—Thomas C. Saitta

(57) ABSTRACT

A water-driven blower ventilation adapter apparatus and method for using the same. The ventilation adapter of the present invention receives separately and expels in mixed combination the gas exhaust and water discharge from a water-driven blower. In accordance with a preferred embodiment, the ventilation adapter of the present invention includes a funnel shaped adapter body having a larger diameter port at the inlet side for receiving a gas exhaust from the water-driven blower and a smaller diameter port at the outlet side from which the gas exhaust is expelled. Furthermore, the ventilation adapter includes a water intake port disposed on the funnel shaped adapter body, which receives and passes water discharged from the water-driven blower into the smaller diameter outlet port of the funnel shaped adapter body such that the gas exhaust and water discharge are expelled in combination through the smaller diameter outlet port.

18 Claims, 3 Drawing Sheets

WATER-DRIVEN BLOWER VENTILATION EXHAUST SYSTEM

BACKGROUND OF THE INVENTION

1. Technical Field

The present invention relates in general to ventilating enclosed or partially enclosed spaces. More particularly, the present invention relates to portable ventilation equipment and methods for deploying and using the same. Still more particularly, the present invention relates to a ventilation system including an integrated ventilation discharge adapter advantageously deployed in concert with a water-powered exhaust blower.

2. Description of the Related Art

The need for fast and efficient removal of atmospheric hazards within confined or partially confined spaces arises in many situations. Ventilation systems are required in such situations in which smoke, contaminated air or toxic gasses are generated or leak into interior compartmentalized spaces such as those found on ships. Removal of smoke or hazardous gases from remote spaces such as encountered during or following a fire in a ship may require that such gases or the fresh air be transported through long ducts at high gas flow or air flow velocities. In most emergency situations it is desirable that the ventilation equipment utilized in removing airborne hazards be sufficiently light and compact to be transported and installed by a minimum number of individuals.

For many shipboard environments such as machinery spaces, the fans or blowers utilized to provide the required suction in such ventilation systems are preferably capable of operating in volatile environments without causing an explosion. In addition, it is critical in many emergency ventilation scenarios that such blowers remain operable in the event that local electrical power source is lost or inaccessible. Water-driven turbine blowers, sometimes referred to as water-powered ram fans, address the foregoing emergency ventilation needs by employing a hydrodynamic turbine mechanism to generate the requisite fan suction. The use of water-driven blowers is well known in the art. For example, U.S. Pat. No. 5,125,797 describes a water turbine driven fan system that includes an air expansion nozzle in combination with a high velocity, high pressure rise fan that provides a means for generating substantial increases in air flow rate.

Large ships, such as Navy vessels and cargo ships, have interiors that are divided by bulkheads into a large number of compartments in order to more readily contain water and fire in case of a fire and/or flooding emergency. In the event of a fire, a standard technique is to temporarily seal off the compartment opening and exhaust the smoke through a portable flexible duct assembly, sometimes referred to as an "elephant trunk." A water-powered turbine blower generates suction, and the exhaust end of the flexible duct is extended out through the deck hatches and/or watertight doors such that the smoke is exhausted from the affected interior space into the atmosphere. The water used to operate the blower is discharged either directly overboard from hoses running through open deck hatches or into the ship's gravity drainage system (e.g. deck drains or deep sink) from which it may be pumped by firemain pumps through overboard discharge fittings in the ship's hull.

A problem associated with using water turbine fans in emergency shipboard circumstances arises from the need to maintain airtight and watertight integrity and the limited water retention capacity of the ship. When a water-driven ram fan is used to ventilate a shipboard compartment, the air duct and water discharge hoses must be extended out through hatchways such that the smoke is exhausted into the atmosphere. Opening watertight doors or hatches from the affected space exposes many other ship compartments and walkways to the harmful atmospheric conditions sought to be expelled. The need to open sometimes multiple hatches during emergency ventilation procedures is further necessitated by the ship's limited water retention capacity requiring extending water hoses through passageways such that the water used to drive the ram fan may be discharged overboard. The dangers associated with a non-sealed ventilation expulsion may be particularly acute when the vented air contains chemical, biological, or radioactive components.

Systems for ventilating contaminated atmospheric conditions are described in U.S. Pat. No. 4,986,364 issued to Clark, and U.S. Pat. No. 2,436,038 issued to Farrell. Clark describes a dual purpose fire fighting and ventilation apparatus comprising a rigid conduit having a water inlet and a fogging nozzle outlet that is used to direct a spray aspiration action to draw smoke and air outwardly from an affected compartment through a non-sealed opening such as a doorway or opening. Farrell discloses a smoke ejector apparatus, which similar to Clark, includes a spray nozzle for directing a water spray to mix with smoke laden gases and direct the gases in an outward direction through an open doorway or window. While providing a means to expel and scrub smoke laden air from an opening in an affected space including the use of spray jet nozzles to facilitate the air outflow, neither Farrell nor Clark address the aforementioned problems related to shipboard ingress and egress containment issues particularly those related to maintaining sealed integrity of the forced-air gas exhaust outflow at the high volumetric flow rates produced by water-driven blowers.

It can therefore be appreciated that a need exists for a safer and more efficient system for removing hazardous atmospheric conditions occurring in the interior spaces and compartments of a ship. The present invention addresses such a need.

SUMMARY OF THE INVENTION

A shipboard ventilation adapter apparatus and method for using the same are disclosed herein. The ventilation adapter of the present invention receives the separate gas exhaust and water discharge sources from a water-driven blower and expels in mixed combination the gas exhaust and water discharge from a common outlet port. The terms "gas" and "gas exhaust" referring herein to contaminated air, smoke, hazardous gasses, airborne particulates and the like. In accordance with a preferred embodiment, the ventilation adapter of the present invention includes a funnel shaped adapter body having a larger diameter port at the inlet side for receiving a gas exhaust from the water-driven blower and a smaller diameter port at the outlet side from which the gas exhaust is expelled. Furthermore, the ventilation adapter includes a water intake port disposed on the funnel shaped adapter body, which receives and passes water discharged from the water-driven blower into the smaller diameter outlet port of the funnel shaped adapter body such that the gas exhaust and water discharge are expelled in combination through the smaller diameter outlet port.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

This invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention.

The present invention is directed to ventilation systems, and in particular to portable exhaust ventilation systems for use on naval and commercial ships. The purpose of exhaust ventilation is to maintain a standard of air quality by removing smoke, fumes, or other types of airborne contaminants from a polluted compartment. Portable ventilation systems are available as a flexible means for removing smoke and gas during post fire or other contaminated environment conditions. Portable ventilation systems including electric driven, air driven, or water-driven blowers with attached flexible hose ducting are commonly utilized for emergency applications where the permanently installed shipboard ventilation system is unavailable or has been rendered inoperable.

As described in further detail with reference to the figures herein, the present invention addresses problems associated with the use of water-driven blowers as the driving means for shipboard portable ventilation systems. As employed in a portable ventilation scenario, a water-driven blower serves as the driving means for expelling contaminated atmospheric conditions from a polluted shipboard compartment. Water-driven blowers, often implemented as water turbine ram fans, are an important feature of any ship's damage control repertoire since they remain operable in case the ship's electrical power supply system is interrupted or rendered inoperable. In addition, properly grounded water-driven blowers are explosion resistant in volatile atmospheric conditions and are relatively lightweight making them particularly well-suited to facilitating a rapid response to emergency damage control situations.

Figure 1:
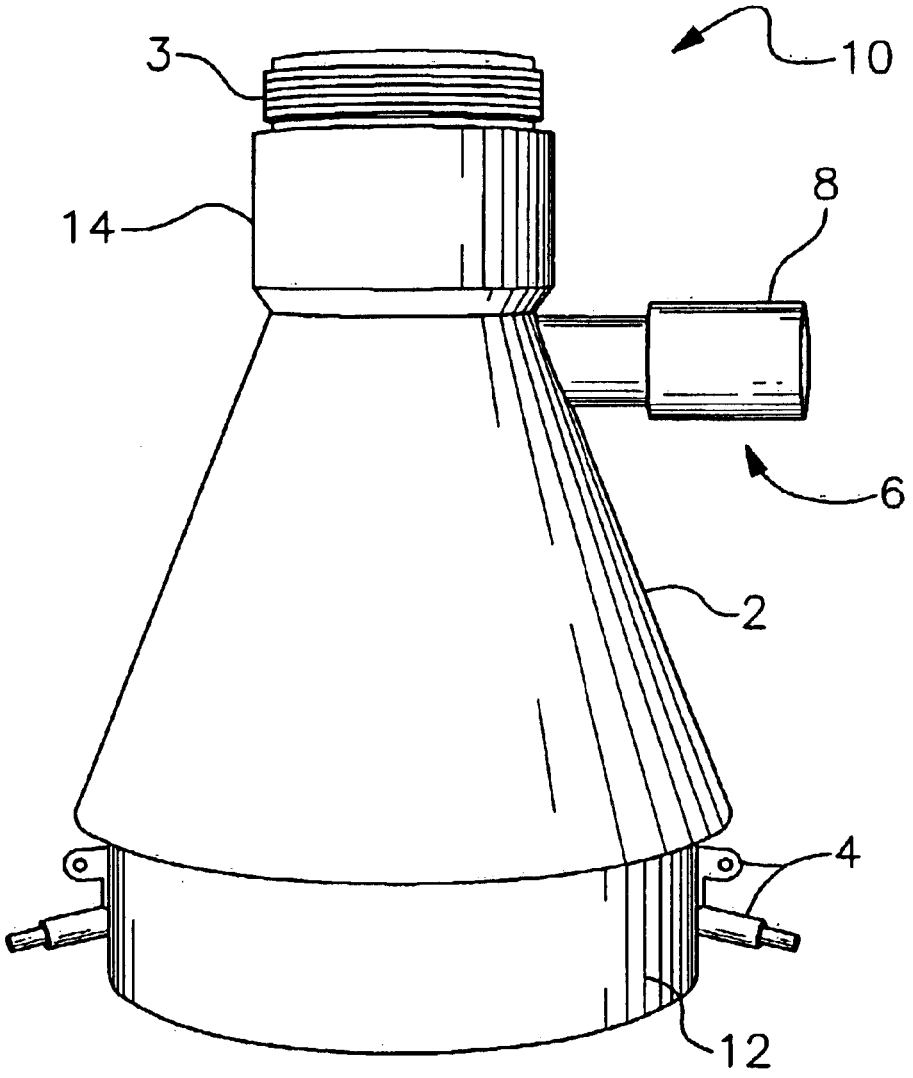
FIG. 1 illustrates an external view of a shipboard ventilation adapter designed to be utilized in conjunction with a water-driven blower in accordance with one embodiment of the present invention.

With reference now to the figures, wherein like reference numerals refer to like and corresponding parts throughout, and in particular with reference to FIG. 1, there is depicted an external view of a shipboard ventilation adapter designed to be utilized in conjunction with a water-driven blower in accordance with one embodiment of the present invention. Specifically, FIG. 1 shows a ventilation adapter 10 that includes a funnel shaped adapter body 2 having a larger diameter gas intake port member 12 and a smaller diameter common outlet port member 14. By "larger diameter" and "smaller diameter" as recited in association with the port members 12 and 14, it is meant that the gas inlet has a relatively larger diameter than the diameter of the common outlet port to accommodate the frustum contoured inner surface boundary of adapter body 2 which provides a suitable gas exhaust transport path having minimized flow turbulence and an enhanced venturi suction effect. This relative size difference between gas intake port member 12 and common outlet port member 14 also accommodates size difference between typical overboard discharge fittings and the exhaust ducts utilized to carry discharged air from water-driven blowers. The term "gas" is taken herein to include contaminated air, smoke, hazardous gasses and airborne particulates.

Figure 3:
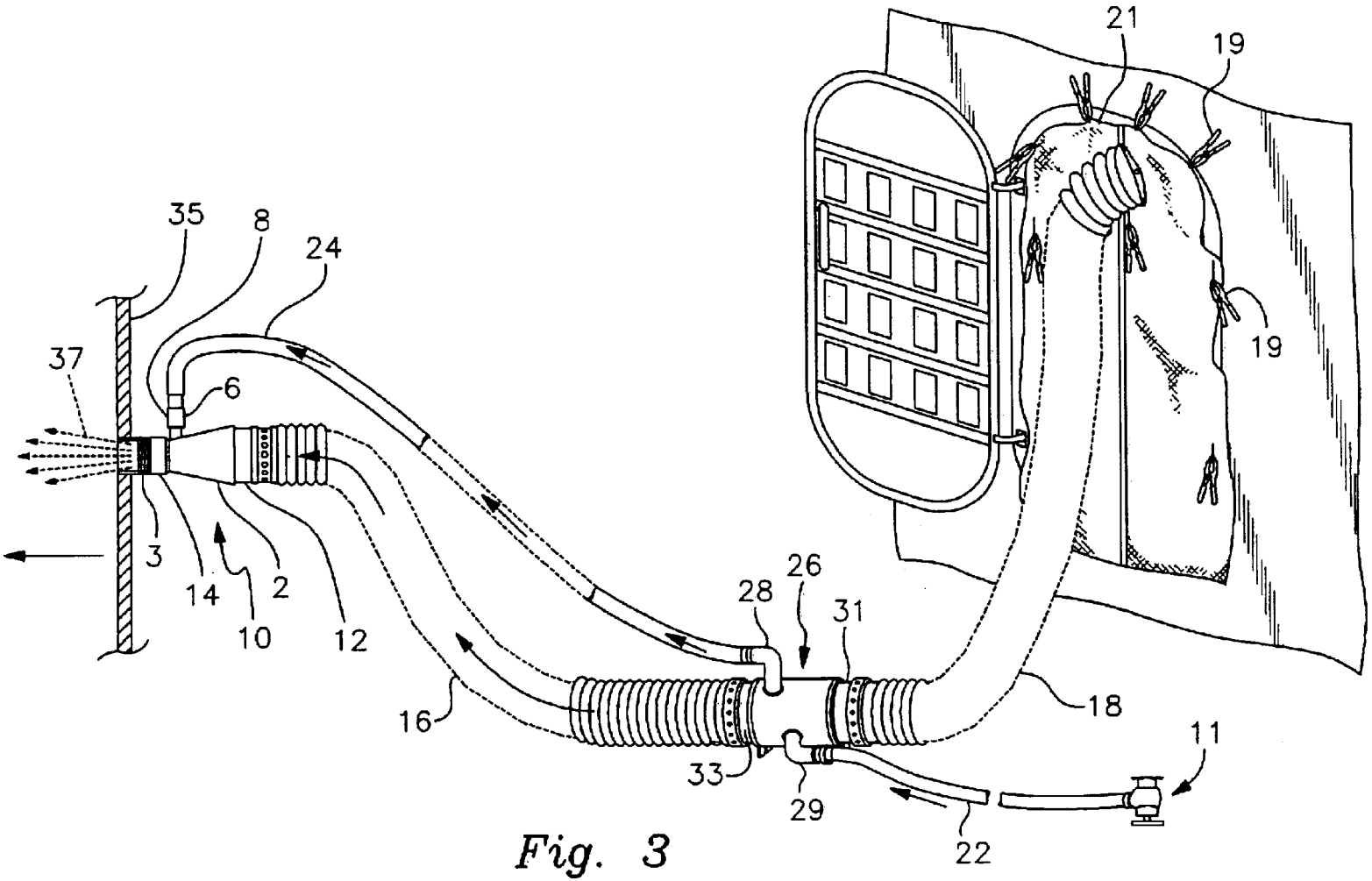
FIG. 3 illustrates a portable shipboard ventilation apparatus that includes a water-driven blower functionally connected to a ventilation adapter in accordance with one embodiment of the present invention.

In accordance with the present invention ventilation adapter 10 includes an overboard discharge connector interface 3 for connectively engaging with an overboard discharge fitting 37 as depicted in FIG. 3. In the depicted embodiment, overboard discharge connector interface 3 comprises a threaded male screw-on connector interface for suitably engaging a suitable female threaded connector interface within overboard discharge fitting 37. Between gas intake port 12 and common outlet port 14, adapter body 2 is a frustum contoured shell with an angular inclination indentation preferably between 15° and 45° from vertical. As explained in further detail herein, the conical chamber which narrows from gas intake port 12 to common outlet port 14 is also useful in providing a nozzle effect in which a negative gas entrainment pressure is created by a mixed gas/liquid discharge at the relatively narrow common outlet port 14 of ventilation adapter 10.

In accordance with the depicted embodiment, gas intake port member 12 is designed to receivably accommodate a tubular duct member and to receive therefrom the gas ventilation exhaust propelled from the air discharge end of a water-driven blower. An exemplary tubular duct member and water-driven blower are depicted in FIG. 3 as constituent features of a portable shipboard ventilation apparatus in accordance with one embodiment of the present invention. As further depicted in FIG. 1, ventilation adapter 10 includes air duct coupling means 4 such as, for example, duct clasps of known type, utilized to secure the end of an air duct tube to gas intake port 12.

Continuing with FIG. 1, and in an important feature of the present invention, ventilation adapter 10 further includes a water intake port 6 disposed on the side of adapter body 2. A hose coupling member 8 is disposed at the end of water intake port 6 for connectively engaging a corresponding attachment end of a water discharge hose extending from the water-driven blower. In the depicted embodiment, hose coupling member 8 is a rotating threaded female coupling member for suitably engaging a threaded male connector disposed at the end of the water discharge hose.

Figure 2:
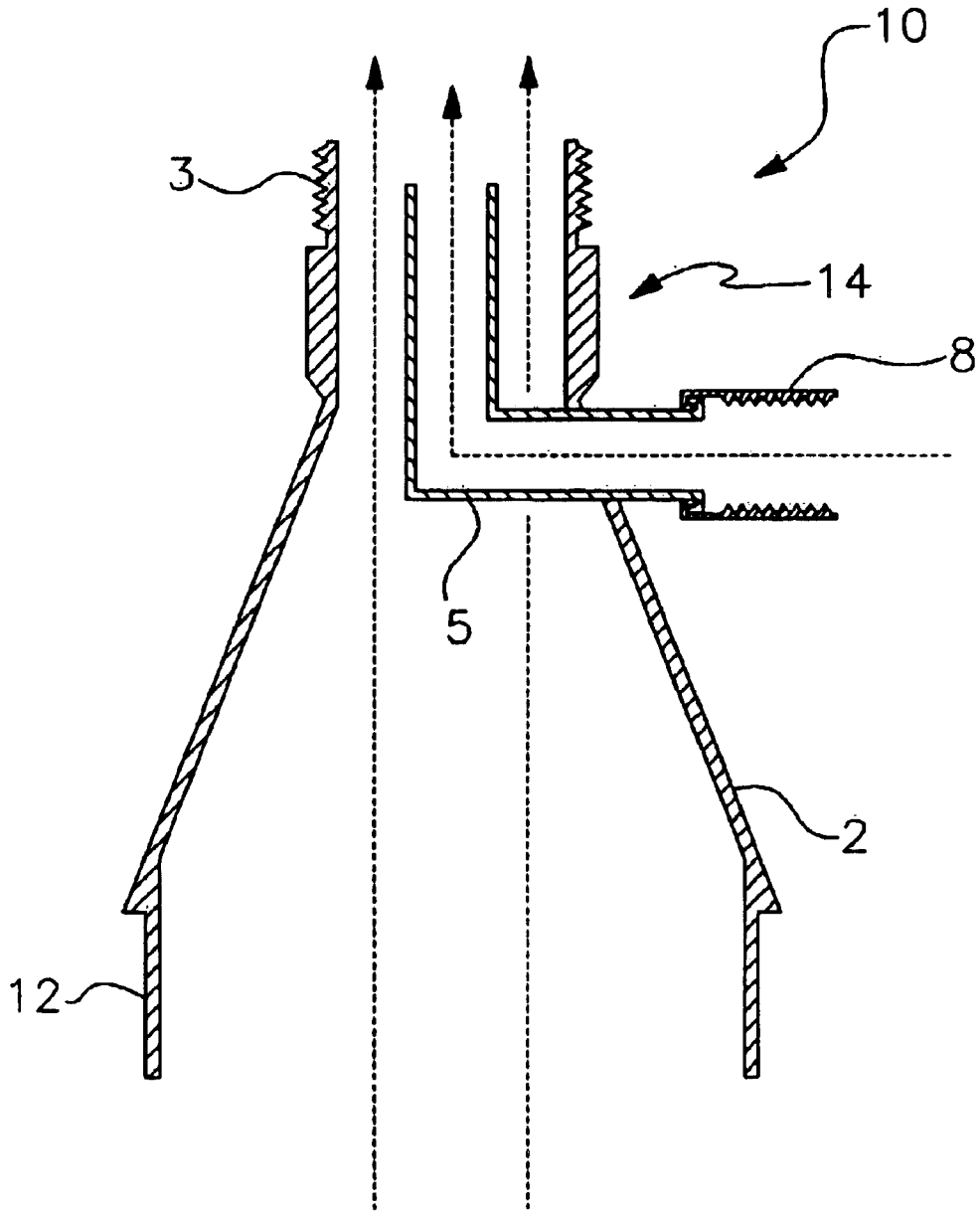
FIG. 2 depicts a cross section view of the ventilation adapter illustrated in FIG. 1 showing the mutual orientation of the air and water intake passageways and the common discharge outlet.

With reference to FIG. 2, there is depicted a cross section view of the ventilation adapter illustrated in FIG. 1 showing the mutual orientation of the air and water intake flow paths and the common discharge outlet. Water intake port 6 further comprises a water discharge conduit 5 in the form of an elbow tube extending into the interior cavity of the funnel shaped adapter body 2 for routing the received water discharge into the smaller diameter common outlet port 14. As further depicted in FIG. 2, the elbow tube is oriented substantially centered within the interior cavity such that the water discharge is directed to flow in the same direction as the gas exhaust passing from gas intake port 12 to common outlet port 14.

The interior chamber of adapter body 2 provides a funneled air passage from gas intake port 12 to common outlet port 14 creating a venturi effect in which exhaust gas blown from the water-driven blower is drawn by the negative pressure condition within and on the outlet discharge side of common outlet port 14 resulting in part from the water discharge flowing from water discharge conduit 5 through common outlet port 14. The combined water/gas discharge from common outlet port 14 further facilitates a desmoking or other airborne particulate decontamination process by its inherent air scrubbing action. In accordance with the embodiments depicted in FIGS. 1 and 2, the particulate laden gas exhaust accelerates to a relatively high velocity in the narrowed throat embodied by common outlet port 14 where it impinges on the water discharge stream. The turbulent gas/water interaction and inertial collisions with drops and mist incident to the discharge stream entraps and entrains the airborne particulates further enhancing the exhaust ventilation efficiency of the adapter.

To accommodate an efficient shipboard damage control application, gas intake port 12, water intake port 6, adapter body 2, and common outlet port 14, are molded and/or welded together as a singular fixed unit. Specifically, the component parts of ventilation adapter 10 are preferably metallic alloys of stainless steel, aluminum, and/or bronze depending on the application and exposure to various environmental conditions such as when firemain seawater is used to actuate the associated water-driven blower and flows into ventilation adapter 10 through water intake port 6.

Referring now to FIG. 3, there is illustrated a portable shipboard ventilation apparatus that includes a water-driven blower 26 employed in conjunction with ventilation adapter 10 in accordance with one embodiment of the present invention. Water-driven blower 26, which in the illustrated embodiment may be a water turbine ram fan, is utilized to draw and discharge contaminated air from an affected compartment. Consistent with characteristic water-driven blower operating principles, a firemain water source supplied by a supply intake hose 22 from a supply globe valve 11 is applied to a supply intake port 29 on water-driven blower 26. The resultant water pressure from the firemain drives an internal turbine mechanism (not depicted) that in turn drives an internal blower fan blade apparatus (not depicted) within water-driven blower 26. The turning fan blades within water-driven blower 26 generate a suction at the inlet side causing air to be drawn into the fan through a gas intake port 31 and blown out of the fan through a gas exhaust outlet port 33. It is the water driven characteristic of water-driven blower 26 that the portable ventilation apparatus shown in FIG. 3 is designed to leverage for safer and more effective ventilation of shipboard compartments. Aside from the basic operating principles set forth herein, the internal structural and operating details of water turbine ram fans and other analogous water-driven blowers are well known in the art and are not further discussed.

In the depicted embodiment, a manually installable smoke curtain 21 and smoke curtain clamps 19 provide a suitably sealed interface at the doorway opening between the affected compartment and the adjacent space in which the ventilation apparatus is deployed and operated. An intake vent duct 18 is extended through an aperture in smoke curtain 21 to provide a bounded conduit through which the withdrawn air is directed from the affected compartment into water-driven blower 26 and out through a gas discharge duct 16. Vent ducts 16 and 18 are flexible, tubular members suitable for portable damage control scenarios and may be any size, such as the 8", 12", or 16" diameters commonly used in such applications. Such ventilation ducts may be constructed of a fire retardant polyvinyl and/or polyester material and preferably include a helical type wire support to prevent tube collapse.

As further illustrated in FIG. 3, ventilation adapter 10 is deployed within the portable ventilation apparatus by engaging threaded overboard discharge interface connector 3 into accommodating female threads on the interior side of an overboard discharge fitting 37 that extends through a seaward bulkhead/hull boundary 35 typically six to twelve feet above the ship's waterline. Gas discharge duct 16 provides a sealed air passage from gas exhaust outlet port 33 to gas intake port 12 while a blower discharge hose 24 is utilized to pass the water discharged from the outlet port of water-driven blower 26 into the water intake port 6 on ventilation adapter 10.

With water-driven blower 26 operating, the air forced from the blower generates a significant forced air flow directed toward ventilation adapter 10 and a corresponding air flow directed away from the ventilation inlet end such that contaminated air within the affected compartment behind smoke curtain 21 is forced toward the gas intake port 12 of ventilation adapter 10 as indicated by the arrows. This air current is expelled overboard in mixed combination with the water discharged from water-driven blower 26 through common outlet port 14 and overboard discharge fitting 37. The expulsion of the discharge water through a common ventilation adapter port through which the exhaust is blown eliminates the need to open additional water discharge pathways through open doorways/hatchways, reduces the required manpower and length of firemain hose otherwise required for a given ventilation evolution, and furthermore contributes to a venturi effect as the mixed gas/water combination is diffused from the narrowed overboard discharge port into the open atmosphere outside of the ship as explained with reference to FIG. 2.

From the foregoing, it can be appreciated that the adapter and ventilation apparatus of the present invention efficiently alleviates problems associated with using water-driven blowers to evacuate contaminated atmospheric conditions occurring in a shipboard environment. Moreover, the ventilation apparatus described herein leverages the otherwise problematic need to discharge a sizable volume of water from a shipboard environment having a limited water retention capacity to facilitate a safer and more effective compartment ventilation process. The adaptor and ventilation apparatus may also be utilized with electrical or pneumatically powered blowers by capping off the water intake port.

It is contemplated that equivalents and substitutions for certain elements and components set forth above may be obvious to those skilled in the art, and therefore the true scope and definition of the invention is to be as set forth in the following claims.

What is claimed is:

1. A water-driven blower ventilation apparatus comprising an adapter and a water-driven blower, wherein said adapter receives separately and expels in mixed combination the gas exhaust and water discharge from said water-driven blower, said ventilation adapter comprising:

a funnel shaped adapter body;

a larger diameter port at the inlet side of said funnel shaped adapter body for receiving a gas exhaust from the water-driven blower;

a smaller diameter port at the outlet side of the funnel shaped adapter body from which the gas exhaust is expelled; and a water intake port disposed on said funnel shaped adapter body, wherein said water intake port receives and passes water discharged from the water-driven blower into the smaller diameter outlet port of said funnel shaped adapter body such that the gas exhaust and water discharge are expelled in combination through the smaller diameter outlet port.

2. The water-driven blower ventilation apparatus of claim 1, wherein said water-driven blower is a water turbine ram fan.

3. The ventilation apparatus of claim 1, wherein the gas exhaust is delivered from said water-driven blower to said larger diameter inlet port through a flexible air duct, said larger diameter inlet port adapted to connectively engage said flexible air duct.

4. The ventilation apparatus of claim 1, wherein said funnel shaped adapter body, said larger diameter inlet port, said smaller diameter outlet port, and said water intake port are mutually coupled as a singular fixed unit.

5. The ventilation apparatus of claim 1, wherein said funnel shaped adapter body, said larger diameter inlet port, said smaller diameter outlet port, and said water intake port are constructed of a metal chosen from the group of metals consisting of stainless steel, aluminum and brass alloy.

6. The ventilation apparatus of claim 1, wherein said funnel shaped adapter body comprises a frustum contoured metallic shell.

7. The ventilation apparatus of claim 6, wherein said larger diameter inlet port and said smaller diameter outlet port are metallic tubular members connected to the ends of said frustum contoured metallic shell.

8. The ventilation apparatus of claim 1, wherein said smaller diameter outlet port is adapted to mechanically couple with an overboard discharge hull fitting.

9. The ventilation apparatus of claim 8, wherein said smaller diameter outlet port includes a threaded male screw-on adapter for connectively engaging a threaded female screw-on adapter within an overboard discharge hull fitting.

10. The ventilation apparatus of claim 1, wherein the water discharge is delivered from the water-driven fan to said ventilation adapter through a discharge hose, said water intake port comprising a coupling member for suitably engaging a corresponding coupling member at the adapter end of the discharge hose.

11. The ventilation apparatus of claim 10, wherein said water intake port further includes an elbow tube extending into the interior cavity of the funnel shaped adapter body for routing the water discharge through the discharge hose coupling engagement into the smaller diameter outlet port, said elbow tube oriented within the interior cavity such that the water discharge is directed to flow in the same direction as the gas exhaust passing from said larger diameter inlet port to said smaller diameter outlet port.

12. A water-driven blower ventilation apparatus comprising:

a water-driven blower having a gas exhaust outlet port and a water discharge outlet port; and a ventilation adapter including:

a gas intake port coupled by an air duct member to the gas exhaust outlet port of the water-driven blower such that said gas intake port receives gas exhaust from said water-driven blower;

a water intake port coupled by a pump discharge hose to the water discharge outlet port of the water-driven blower such that said water intake port receives water discharged from said water-driven blower; and a common discharge port that is smaller in diameter than said gas intake port from which the received gas exhaust and water discharge are expelled from the ventilation adapter in mixed combination.

13. The water-driven blower ventilation apparatus of claim 12, wherein said water-driven blower is a water turbine ram fan.

14. The water-driven blower ventilation apparatus of claim 12, wherein said common discharge port is adapted to be selectively installed into an overboard discharge hull fitting.

15. The water-driven blower ventilation apparatus of claim 12, wherein said ventilation adapter further includes a funnel shaped adapter body having a larger diameter inlet comprising said gas intake port and a smaller diameter outlet comprising said common discharge port.

16. The water-driven blower ventilation apparatus of claim 15, wherein said water intake port is disposed through the side of the funnel shaped adapter body.

17. A method for ventilating a polluted shipboard compartment, wherein a water-driven blower is utilized to draw air from the polluted shipboard compartment, said method comprising:

coupling a common discharge port of a ventilation adapter to an overboard discharge hull fitting;

coupling a gas exhaust discharge port from the water-driven blower to a gas intake port on the ventilation adapter;

coupling a water discharge port from the water-driven blower to a water intake port on the ventilation adapter; and applying water pressure to actuate the water-driven blower such that gas exhaust and water discharge from the water-driven blower are passed to the gas intake port and water intake port, respectively, and expelled overboard as a mixture through the common discharge port.

18. The method of claim 17, further comprising:

installing a smoke curtain to seal an opening to the polluted shipboard compartment; and drawing the air from the polluted shipboard compartment into an air intake port on said water-driven blower utilizing a portable conduit that extends through the smoke curtain such that one end extends into the shipboard compartment and the opposite end extends outside and is coupled to the air intake of the water-driven blower.

* * * * *